United States Patent [19]

Smit

[11] Patent Number: 4,520,345

[45] Date of Patent: May 28, 1985

[54] ASH TRAY HAVING FIRE PROTECTING ACTIVITY

[76] Inventor: Karlo Smit, Nybrogatan 76, S-114 41 Stockholm, Sweden

[21] Appl. No.: 372,439

[22] Filed: Apr. 27, 1982

[30] Foreign Application Priority Data

Apr. 27, 1981 [SE] Sweden ..... 8102668

[51] Int. Cl.[3] ..... F23N 5/26; G08B 1/00

[52] U.S. Cl. ..... 340/309.2; 368/10; 340/309.15; 131/231; 131/238

[58] Field of Search ..... 340/309.2, 309.3, 309.15, 340/309.4, 309.5, 405; 368/10

[56] References Cited

U.S. PATENT DOCUMENTS

| | | | |
|---|---|---|---|
| 3,205,900 | 9/1965 | Dahl | 340/405 X |
| 3,360,790 | 12/1967 | Rossitto | 340/309.15 |
| 4,311,448 | 1/1982 | Strauss | 340/309.15 X |

FOREIGN PATENT DOCUMENTS 7801748 2/1979 Sweden .

*Primary Examiner*—John W. Caldwell, Sr.
*Assistant Examiner*—E. Harding
*Attorney, Agent, or Firm*—James E. Nilles

[57] ABSTRACT

An ash tray having fire protecting activity and comprising an ash tray body (2) including an ash container (24) and an internal or external time delay circuit which is connected to an acoustic and/or optical alarm and supervising means. The ash tray is formed with a lid (3) which is normally intended to be closed, whereby the time delay circuit (25) and any other units connected thereto are disconnected but which upon opening of the lid actuates the time delay circuit, whereby the time delay circuit provides an alarm signal unless the lid (3) is closed before a predetermined set time delay has passed to an end. The lid (3) preferably is actuated by a spring (16) which tends to open the lid and against the action of which the lid can be closed, whereby the time delay circuit (25) and the alarm means connected thereto are reset. The ash tray may include a cigarette lighter (32) which is covered and non-actuatable when the lid is closed but which is exposed and can be actuated when the lid is opened.

6 Claims, 5 Drawing Figures

ASH TRAY HAVING FIRE PROTECTING ACTIVITY

The present invention generally relates to an ash tray for smokers, and more particularly the invention is concerned with an ash tray which is formed so as to emit a strong alarm sound signal after a predetermined time has passed from the moment that the smoking person has started smoking.

Every year several fires start because a smoking person has put down and forgotton a burning cigarette or cigar which, due to self-burning, drops down from an ash-tray and sets other burnable materials on fire. Still more often it happens that persons are burnt or are burnt to death in their houses owing to the fact that a person in case of bed smoking falls asleep away from his cigarette. Many different attempts have been made to eliminate or at least reduce the number of fires resulting from smoking.

For instance there is suggested in the Swedish patent 78 01748-0, publication No. 406 542, that an ash-tray be made with a switch which upon actuation starts a clock-work which after a predetermined time in turn actuates a buzzer which emits a signal of warning unless the clock-work is stopped before that. The apparatus described in the patent functions satisfactorily provided that the ash-tray is used as intended and that the smoking person starts the clock-work at the same time as the cigarette, the cigar, the pipe or the like is lighted. The buzzer tone, however, in many cases is considered to be annoying, and since the ash-tray can as well be used without starting the clock-work the smoking person may neglect to start the clock-work, especially if the person in question believes himself to be sure not to forget the cigarette or to fall asleep away from the cigarette.

The object of the invention therefore is to provide an ash-tray which under no circumstances can be used unless a special safety operation is started which is ended with the emissions of a strong acoustic or even optical alarm signal or stopping the smoking and the interrupting safety operation before the said alarm signal is emitted.

According to the invention this is provided for in an ash-tray of the type mentioned above in that the ash-tray is formed with a lid which normally is kept closed and which when upon being opened activates a time delay circuit having a siren or any other type of alarm means connected thereto, and in which the time delay circuit after a predetermined time activates the alarm means to emit a strong acoustic or optical signal unless the time delay circuit and thereby the alarm means is inactivated before that by closing the lid.

In a special embodiment of the invention a cigarette lighter can be mounted in the ash-tray underneath the closed lid so that the lighter does not appear and cannot be used until the lid is opened and the time delay circuit has started its operation. Since the ash-tray consequently cannot be used without at the same time starting the alarm system the ash-tray provides assurance that the smoker does not forget or fall asleep away from his cigarette and thereby affords safety against fire.

Further characteristics of the invention and advantages therewith will be evident from the following detailed description in which reference will be made to the accompanying drawings.

In the drawings

Figure 1:
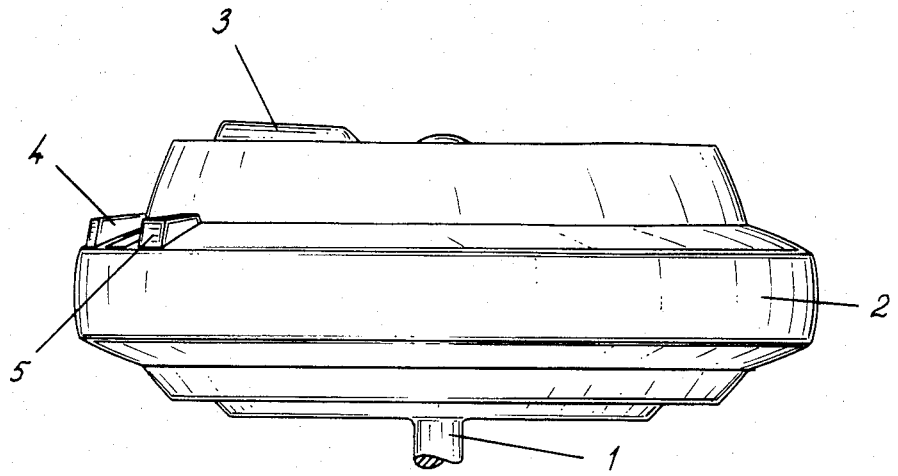
FIG. 1 is a side view of an ash-tray according to the invention.

The illustrated ash-tray may be a table ash-tray or a floor ash-tray mounted on a column 1. The ash-tray comprises a body 2 which includes a collection container and an electrical, electronic or mechanical apparatus for providing a fire protecting activity and an electrical, electronic or mechanical means for activating the ash tray. The essential feature of the invention is that the ash-tray is formed with a lid 3 which in its normally closed position maintains the fire protecting electronic means and the alarm siren inactivated. For the actuation of the ash-tray there is a switch or button 4 actuatable from outside for providing an opening of the lid and thereby a starting of the fire protecting activity. The ash-tray also can be formed with a further switch 5 actuatable from outside and preferably subordinated to switch 4 for providing an actuation of a cigarette lighter included in the ash tray.

The ash tray body may have any wanted form or size, and the lid may be opened by rotation upwards or it may be mounted to be openable or closable in any other way. What is important to the invention is that the lid cannot be opened without starting the electrical, electronic or mechanical means providing the fire protecting function, and that the lid when subsequently closed resets all such means to a starting position.

In the illustrated case the ash tray has a round form and the lid which is likewise round is formed as a visor having eight visor discs 7 which are interconnected to each other. The uppermost visor disc is formed with a grip 8 by means of which the lid can be easily closed.

Figure 3:
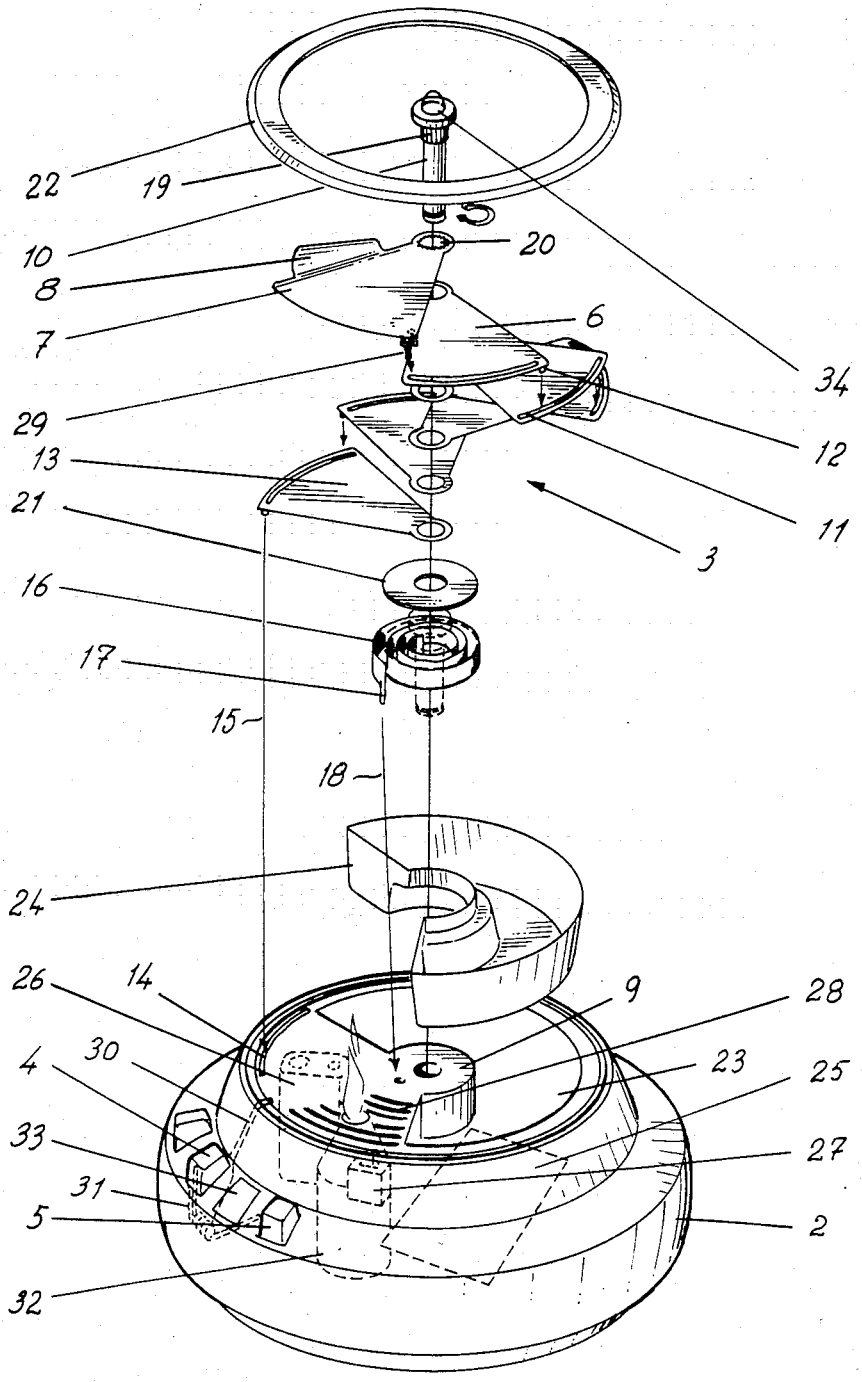
FIG. 3 is an exploded perspective view of the ash tray.

The mechanical design of the ash tray is most evident from FIG. 3. The ash tray body 2 is formed with a central carrier portion 9 in which a central shaft 10 is mounted. On the central shaft the visor discs 6 and 7 are rotatably mounted. Every visor disc except for the uppermost visor disc 7 is formed with an arcuate slot 11 which is concentric to the shaft 10 and in which a pin 12 of the adjacent upper visor disc engages. The pin of the lowermost visor disc 13 engages in a slot 14 in the central carrier portion 9 as indicated with the arrow 15. For the actuation of the visor discs in the opening direction there is a spiral spring 16 having a pin 17 at one end which is secured in a bore of the central carrier portion 9 as indicated with the arrow 18. The inner end of the spring 16 is secured to the central shaft 10. For the actuation of the visor discs the upper end of the central shaft 10 is formed with splines 18 which cooperate with corresponding rifles 20 of the uppermost visor disc 7. A washer 21 keeps the spiral spring 16 in contact with the lowermost visor disc 13. An upper carrier ring 22 cooperates with the central shaft 10 to maintain the visor discs and the spiral spring locked to the body 2.

The ash tray body is formed with a sector like recess 23 in which an ash container 24 fits. The ash container 24 is removably mounted under the visor discs. The container 24 can be removed and emptied and cleaned respectively only when the lid is open and the visor discs are moved away to the position shown in FIG. 4.

In this case the fire protecting activity of the ash tray is established by a diagrammatically indicated electronic circuit card 25, which is supplied with current from a battery 26 which can be put into the ash tray and which is connected to a switch 27. The circuit card 25 includes a time delay circuit which is known per se and which can be adjusted to a suitable time delay that preferably corresponds to slightly more than the normal time for smoking a cigarette, for instance a time of 5–8 minutes. The circuit card further is connected to a non-illustrated siren which is also known per se and which after the lapse of the adjusted time is actuated and emits a strong acoustic signal through a sound opening 28- which is covered when the lid is closed but which is exposed when the lid is opened.

In order to keep the lid in the closed position the uppermost visor disc 7 has a locking pin 29 which cooperates with an arm 30 mounted in the opening button 4 to keep the lid in the closed position. The opening button 4 and thereby the locking arm 30 can be actuated by a spring 31 as indicated in FIG. 3.

In the body 2 also a cigarette lighter 32 can be mounted, which lighter is adapted to be actuated by a lighter button 5. When the lid is closed the cigarette lighter 32 is covered by the visor discs and preferably the lighter is thereby inactivated so that it can be lit only when the lid is open. Between the starting switch 4 and the intermediate switch 5 there is shown an opening in which for instance an indicator lamp 33, e.g. indicating the charge status of the battery 26, can be mounted. Alternatively an indicator lamp 34 can be mounted at the top of the central shaft 10.

The ash tray according to the invention also can be formed with an adaptor 35 for mains connection of the circuit card 25 etc. and/or for connection of the ash tray to an optical signal means or to a central alarm unit, by means of which a large number of ash trays may be supervised, for instance in hotels, hospitals or other institutions.

Figure 2:
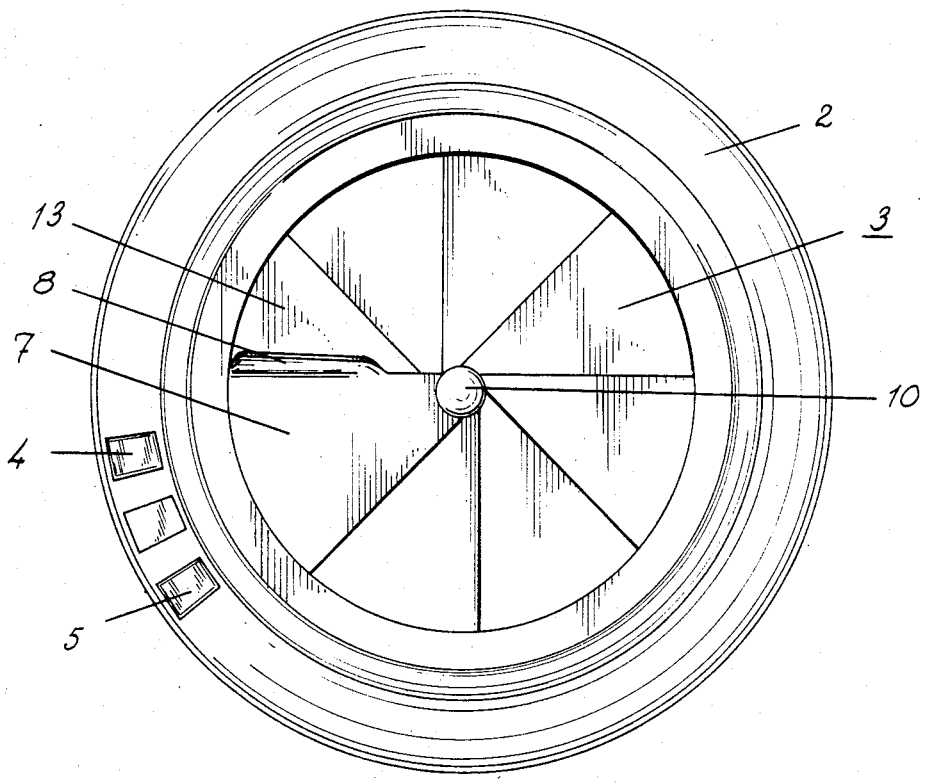
FIG. 2 is a top view of the ash-tray.
Figure 4:
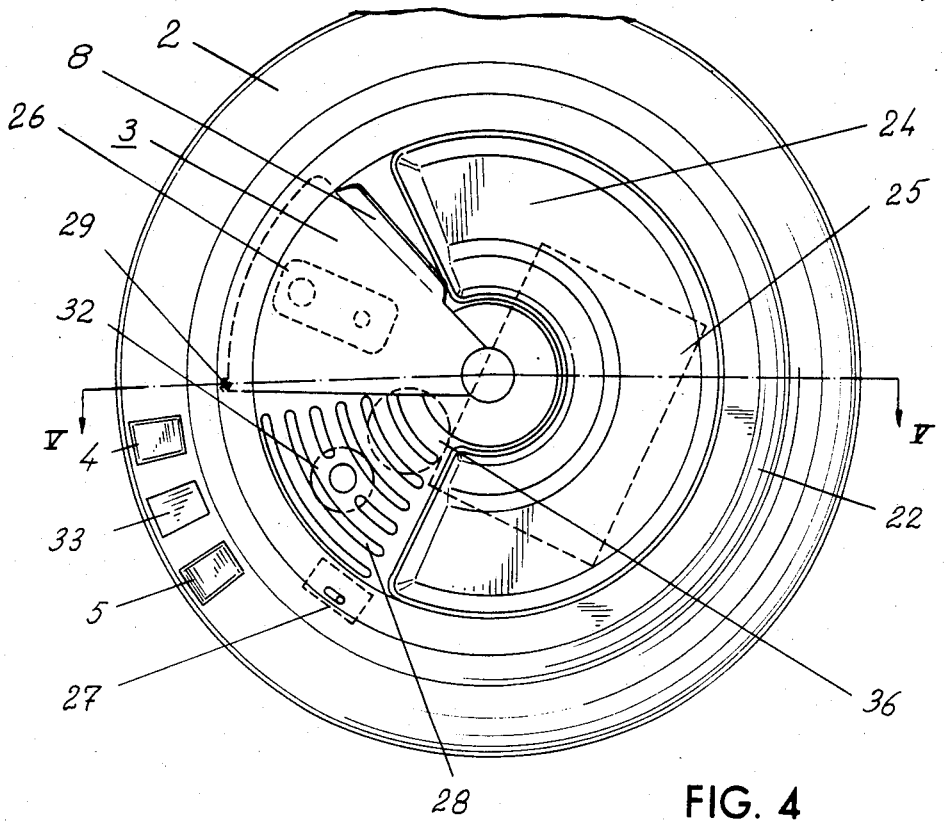
FIG. 4 is a top view of the ash-tray similar to that of FIG. 2, but with the lid open.
Figure 5:
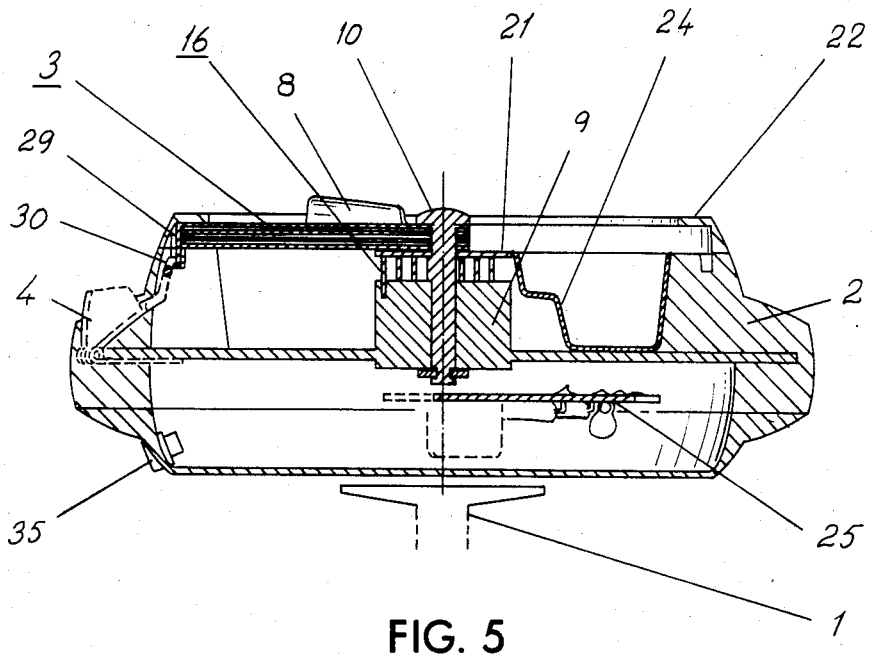
FIG. 5 is a cross section along line V—V or FIG. 4.

The ash tray according to the invention operates as follows: Normally the lid 3 is closed as shown in FIG. 2, whereby the uppermost visor disc 7 is locked in that the locking pin 29 thereof engages behind the locking arm 30 of the opening switch 4. It should be noted that all visor discs are steadily locked in relation to each other by the grooves 11, 14 and the pins 12. When the ash tray is to be used the opening button 4 is pressed down, whereby the uppermost visor disc 7 is released and rotates in the counter-clock-wise direction from the position shown in FIG. 2 to the position shown in FIG. 4. The pin 12 of the uppermost visor disc 7 brings around the uppermost disc but one, etc., so that when the lid is open all visor discs are positioned above each other as one single sector as shown in FIG. 4. In this position both the ash container 24 and the sound opening 28 and the cigarette lighter 32, which may be present, are exposed.

As soon as the uppermost visor disc 7 starts to move the locking pin 29 thereof actuates the switch 27 which thereby supplies current to the time delay circuit of the electrical circuit card 25. If the lid is not closed before the delay time set by the time delay circuit has expired, the circuit card supplies current to a siren 36 emitting a strong sound through the sound opening 28. The time delay circuit also can be connected to an optical signal means so that a flashing or other light appears. As mentioned above the time delay circuit also can be connected to a central supervising station in which a sound or light signal immediately is observed when the ash tray indicates the alarm.

For disconnecting the time delay circuit when the smoking is stopped the lid is closed by grasping the grip 8 and rotating the uppermost and thereby all other visor discs back to the closed position as shown in FIG. 2. When the locking pin 29 of the uppermost visor disc passes the switch 27 the current is disconnected and the circuit card with the time delay circuit is reset to its initial starting position.

It is to be understood that the above description and the embodiment of the invention illustrated in the drawings is only an illustrating example and that many different modifications may be presented within the scope of the appended claims.

I claim:

1. An ash tray whereby a smoker is alerted to possible fire danger due to lighted smoking material that has been forgotton or misplaced, comprising a tray body wherein there is an upwardly opening ash receptacle, an electrically operated alarm device for producing a perceptible alarm signal, and current supply means for energizing said alarm device, said ash tray being characterized by:

A. time delay circuit means energizable from said current supply means and connected with said alarm device to provide for energizing the same after the time delay circuit means has been connected with said current supply means continuously through a predetermined period of time;

B. a normally open switch in said tray body, connected between said current supply means and said time delay circuit means and closure of which connects the time delay circuit means with the current supply means;

C. a lid on said tray body, movable relative thereto in opposite directions to and from a closed position overlying said ash receptacle to prevent deposit of ashes into the same; and D. cooperating actuating means on said switch and on said lid whereby movement of said lid away from its closed position closes said switch and thus initiates a period of energization of the time delay circuit means and whereby movement of said lid back to its closed position reopens the switch and terminates energization of the time delay circuit means.

2. The ash tray of claim 1, further characterized by:

E. spring means reacting between the tray body and said lid to bias the latter away from its closed position; and F. pushbutton latching means on said tray body, engageable with the lid when the same in it its closed position to confine the lid in that position againt the bias of said spring but manually actuatable to release the lid for movement away from that position in response to the bias of said spring.

3. The ash tray of claim 1 wherein said time delay circuit means comprises a printed circuit board in said tray body.

4. The ash tray of claim 1, further characterized by:

E. a lighter in said tray body, in a position to be overlain and rendered inaccessible by said lid when the same is in its closed position but to be readily accessible when the lid is substantially out of its closed position.

5. The ash tray of claim 1 wherein said lid comprises a plurality of edgewise slidable sector-shaped disc elements which slide flatwise over one another as the lid is moved away from its open position.

6. The ash tray of claim 5 wherein each of said sector shaped disc elements has a downwardly projecting pin which is received in an arcuate slot in an adjacent disc element to provide connections between the disc elements whereby each can have limited motion in said opposite directions relative to its adjacent disc element.

* * * * *